US006145702A

United States Patent [19]

Lin et al.

[11] Patent Number: 6,145,702

[45] Date of Patent: Nov. 14, 2000

[54] METHOD AND APPARATUS FOR ADJUSTING MINIMUM LIQUID LEVEL IN A LIQUID SUPPLY BOTTLE

[75] Inventors: Yu-Liang Lin, Hsin-Chu; Ming-Der Chen, Tainan; Eric Chen, Shin Chu, all of Taiwan

[73] Assignee: Taiwan Semiconductor Manufacturing Co., Ltd., Hsin Chu, Taiwan

[21] Appl. No.: 09/412,223

[22] Filed: Oct. 5, 1999

[51] Int. Cl.[7] ..... B65B 1/04

[52] U.S. Cl. ..... 222/64; 222/163; 141/95; 248/132

[58] Field of Search ..... 222/64–69, 163, 222/184, 173; 141/95; 248/132, 157

[56] References Cited

U.S. PATENT DOCUMENTS 3,845,884 11/1974 Hall et al. ..... 222/173
4,510,978 4/1985 Arens ..... 141/65
5,700,401 12/1997 Weinberg et al. ..... 222/64

*Primary Examiner*—Steven O. Douglas
*Attorney, Agent, or Firm*—Tung & Associates

[57] ABSTRACT

An apparatus for adjusting a minimum liquid level in a liquid supply bottle that utilizes a novel height adjustment means and a method for utilizing such apparatus are provided. In the apparatus, a height adjustment means that is positioned on a base frame of a bottle station for supporting a liquid supply bottle is used. The height adjustment means includes two sliding blocks each having a right-angled triangular cross-section slidingly engaging each other on their hypotenuses. The two sliding blocks may be driven by two screws each threadingly engaging one of the side frames for pushing (or pulling) the sliding blocks toward (or away from) each other such that an elevation of the bottle can be increased (or decreased). The present invention novel apparatus further utilizes a bottle clamp which frictionally engaging the liquid supply bottle and hold it in place while allowing the bottle be moved up and down by slidingly engaging a vertical arm of the clamp with a side frame on the bottle station.

20 Claims, 2 Drawing Sheets

METHOD AND APPARATUS FOR ADJUSTING MINIMUM LIQUID LEVEL IN A LIQUID SUPPLY BOTTLE

FIELD OF THE INVENTION

The present invention generally relates to an apparatus and a method for adjusting a liquid level in a liquid supply bottle and more particularly, relates to an apparatus and a method for adjusting a minimum liquid level in a liquid supply bottle sensed by a capacitance sensor by utilizing a height adjustment means positioned under the bottle such that the elevation of the bottle can be changed.

BACKGROUND OF THE INVENTION

Spin-on-glass (SOG) is frequently used for gap fill and planarization of inter-level dielectrics (ILD) in multi-level metalization structures. It is a desirable material for low-cost fabrication of IC circuits. Commonly used SOG materials may be of two basic types, i.e., an inorganic type of silicate based SOG and an organic type of siloxane based SOG. One of the typical organic type SOG materials is a silicon oxide based polysiloxane which is featured with radical groups replacing or attaching to oxygen atoms. Based on the two basic structures, the molecular weight, the viscosity and other desirable film properties of SOG can be modified and adjusted to suit the requirement of a specific IC fabrication process.

SOG film is typically applied to a pre-deposited oxide surface as a liquid to fill gaps and steps on the substrate. Similar to the application method for photoresist films, a SOG material can be dispensed onto a wafer and spun at a rotational speed which determines the thickness of the layer. After the film is evenly applied to the surface of the substrate, it is cured at a temperature of approximately 400° C. and then etched back to achieve a smooth surface in preparation for a capping oxide layer onto which a second inter-level metal may be patterned. The purpose of the etch-back step is to leave SOG between metal lines but not on top of the metal, while the capping oxide layer is used to seal and protect SOG during further fabrication processes. The siloxane based SOG material is capable of filling 0.15 micron gaps and therefore it can be used in 0.25 micron technology.

When fully cured, silicate SOG has similar properties like those of silicon dioxide. Silicate SOG does not absorb water in significant quantity and is thermally stable. However, one disadvantage of silicate SOG is the large volume shrinkage during curing. As a result, the silicate SOG retains high stress and cracks easily during curing and further handling. The cracking of the SOG layer can cause a serious contamination problem for the fabrication process. The problem can sometimes be avoided by the application of only a thin layer, i.e., 1000~2000Å of the silicate SOG material.

In the process of applying a liquid SOG material to a wafer surface, the liquid SOG material is usually fed from a liquid supply bottle in a SOG bottle station. Since the SOG liquid is consumed during the coating process, the level of the liquid in the supply bottle must be continuously monitored. A liquid level sensor, such as a capacitance sensor, is frequently used for such purpose. A conventional SOG bottle station is shown in FIG. 1.

The conventional SOG bottle station 10 shown in FIG. 1 consists mainly of a frame member 12 and a liquid level sensor 24 mounted on one of the horizontal frames 14 of the bottle station 10. A dip tube 8 is immersed in the liquid contained in bottle 16 for the delivery of SOG liquid 22 from the bottle. An open end of the dip tube is normally positioned close to the bottom 18 of the bottle such that most of the liquid stored in the bottle can be utilized.

In the arrangement of the conventional SOG bottle station 10 shown in FIG. 1, the level sensor 24 is normally mounted at a position as low as possible such that most of the SOG liquid 22 stored in the bottle can be syphoned out by the dip tube 8. The maximum usage of the SOG liquid 22 contained in bottle 16 allows a lower fabrication cost. The level sensor 24 which is mounted on the horizontal frame member 14 senses a low liquid level and sends out a warning signal to the machine operator to replace the bottle with a full bottle. When the liquid level sensor 24 is positioned too low relative to the bottle position, a danger of sucking air into the dip tube 8 exists which frequently results in air bubbles being mixed with the SOG liquid 22 and delivered to a wafer surface. When the SOG liquid that contains air bubbles is spin coated on a wafer surface, severe quality problems in the SOG coating are produced which in worst cases, may result in the complete scrap of the wafer. Even when only a minute amount of air bubbles are included in the SOG coating, a part of the wafer must be scraped resulting in a serious yield loss.

In the conventional SOG bottle station 10, the relative positions of the bottle 16 and the fixture frame 12 are fixed such that, in order to change the low liquid level sensed by the liquid level sensor, the position of the sensor itself must be changed which is very difficult. It is therefore desirable to provide a SOG bottle station that allows the position of the bottle be changed with relative ease without disturbing the fixture frame or the position of the level sensor mounted on the fixture frame.

The low liquid level must be sensed by a level sensor at a sufficient low position in the bottle in order to save costs. On the other hand, it must be insured that air bubbles are not syphoned into the dip tube or into the SOG liquid stored in the bottle.

It is therefore an object of the present invention to provide a SOG bottle station for feeding a liquid SOG to a coating apparatus without the drawbacks or shortcomings of the conventional bottle stations.

It is another object of the present invention to provide a SOG bottle station for feeding a liquid SOG to a coating apparatus wherein the elevation of the bottle can be readily adjusted.

It is a further object of the present invention to provide a SOG bottle station for supplying a liquid SOG to a coating apparatus wherein a low liquid level in the bottle can be reliably sensed by a level sensor mounted on a fixture frame of the bottle station.

It is another further object of the present invention to provide a SOG bottle station for feeding a liquid SOG to a coating apparatus wherein the position for sensing a low liquid level in the bottle can be suitably adjusted without adjusting the position of the liquid level sensor.

It is still another object of the present invention to provide a SOG bottle station for feeding a liquid SOG material to a coating apparatus wherein a low liquid level in the bottle can be reliably detected by changing the elevation of the bottle within a range between about 5 mm and about 50 mm.

It is yet another object of the present invention to provide a SOG bottle station for feeding a liquid SOG to a coating apparatus by utilizing a height adjustment means for supporting the liquid supply bottle.

It is still another further object of the present invention to provide a method for adjusting a liquid level in a liquid supply bottle sensed by a level sensor by providing a height adjustment means for supporting a liquid supply bottle thereon such that the elevation of the bottle can be easily adjusted.

It is yet another further object of the present invention to provide a method for adjusting a liquid level in a liquid supply bottle sensed by a level sensor by utilizing a height adjustment means consisting of two sliding blocks of right-angled triangular cross-section slidingly engaging each other on their hypotenuses which supports a liquid supply bottle on top.

SUMMARY OF THE INVENTION

In accordance with the present invention, an apparatus and a method for adjusting a minimum liquid level in a liquid supply bottle are provided.

In a preferred embodiment, an apparatus for adjusting a minimum liquid level in a liquid level supply bottle is provided which includes a base frame, at least two vertical side frames opposingly mounted on the base frame and bridged by a horizontal frame, a bottle clamp wich has a vertical arm for frictionally engaging one of the at least two side frames allowing vertical motion of the clamp and a horizontal arm for frictionally engaging a bottle positioned on a height adjustment means, and a height adjustment means positioned on the base frame for supporting the bottle, the height adjustment means includes two siding blocks each having a right-angled triangular cross-section slidingly engaging each other on their hypotenuses and two screws each threadingly engaging one of the at least two side frames for pushing the sliding blocks toward each other such that an elevation of the bottle is increased.

The apparatus for adjusting a minimum liquid level in a liquid supply bottle may further include a level sensor mounted on the horizontal frame for sensing a liquid level in the supply bottle, or a liquid feed tube mounted in the bottle which has an opened end immersed in a liquid in the bottle. Each of the sliding blocks in the height adjustment means may have a maximum thickness between about 5 mm and about 50 mm, preferably between about 10 mm and about 20 mm. The open end of the liquid feed tube may be positioned adjacent to a bottom surface of the liquid supply bottle. The liquid supply bottle may have a capacity of about 1,000 cc, while the level sensor may be of the capacitance sensor type. The level sensor may sense a liquid level in the liquid supply bottle at about 200 cc. The elevation of the liquid supply bottle may be increased by a motion of the two sliding blocks to a maximum increase of about 20 mm. The liquid supply bottle may be adapted for holding a liquid of spin-on-glass or photoresist.

The present invention is further directed to a method for adjusting a liquid level in a liquid supply bottle sensed by a level sensor that can be carried out by the operating steps of providing a bottle holding fixture including a base frame, at least two opposing side frames mounted on the base frame and a horizontal frame bridging the at least two side frames, positioning a height adjustment means consisting of two sliding blocks of right-angled triangular cross-section slidingly engaging each other on their hypotenuses on the base frame for supporting a bottle thereon, positioning a liquid supply bottle on the height adjustment means, holding a position of the liquid supply bottle by a bottle clamp which allows a vertical motion of the bottle, and pushing the two sliding blocks toward each other such that an elevation of the bottle is increased.

In the method for adjusting a liquid level in a liquid supply bottle sensed by a level sensor, the step of pushing the two sliding blocks toward each other may further include mounting two screws by threadingly engaging each with one of the at least two opposing side frames and by attaching each of the two inwardly facing ends of the screws to one of the sliding blocks, and turning at least one of the two screws and pushing the two sliding blocks toward each other.

The method for adjusting a liquid level in a liquid supply bottle sensed by a level sensor may further include the step of mounting a liquid feed tube in the bottle with an open end immersed in a liquid. The method may further include the step of pushing the two sliding blocks toward each other such that the elevation of the bottle is increased by at least 5 mm, or increased between about 5 mm and about 50 mm. The method may further include the step of mounting a level sensor on the horizontal frame for sensing a liquid level in the bottle, or mounting a capacitance sensor on the horizontal frame for sensing a liquid level in the bottle. The method may further include the step of sensing a low liquid level in the liquid supply bottle by a level sensor and sending a signal to stop a delivery of liquid from the bottle, or the step of sensing a liquid level of about 200 cc in the supply bottle by a capacitance sensor and sending a signal to stop a delivery from the bottle.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

Figure 1:
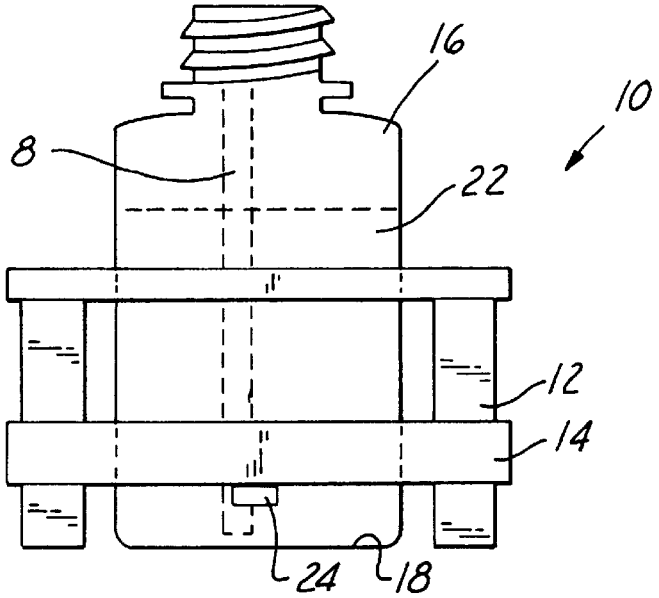
(PRIOR ART) FIG. 1
FIG. 1 is a cross-sectional view of a conventional SOG bottle station with a SOG bottle held therein and shown in ghost lines.

The present invention discloses an apparatus and a method for adjusting a minimum liquid level sensed in a liquid supply bottle by a level sensor, or a capacitance type sensor. The apparatus includes provisions for adjusting an elevation of the liquid supply bottle such that the low liquid level sensed by the level sensor can be suitably adjusted as desired.

The present invention novel apparatus and method for using the apparatus allow a maximum use of the liquid contained in a liquid supply bottle such that any excessive waste of unused liquid in the bottle can be minimized. The present invention novel apparatus and method further allows the delivery of a liquid to a process machine without any danger of containing air bubbles that are inadvertently sucked in by a liquid delivery tube immersed in the bottle due to an inaccurate sensing of the low liquid level. A processing defect of forming a coating layer on a semiconductor substrate due to the presence of air bubbles which leads to a complete scrap or a partial scrap of a semiconductor substrate can therefore be eliminated. The reliability of the coating process and the yield of the fabrication process can be insured and improved.

In the present invention novel apparatus, a height adjustment means is utilized which is positioned on a base frame for supporting a liquid supply bottle thereon. The height adjustment means is constructed of two sliding blocks each having a right-angled triangular cross-section such that the two sliding blocks slidingly engaging each other on their hypotenuses. The adjustment may be made by two screws each threadingly engaging one of the side frames for pushing (or pulling) the sliding blocks toward (or away from) each other so that an elevation of the bottle can be increased (or decreased). The height adjustment means can be easily fabricated and used in the present invention SOG bottle station with minimum amount of modification required to an existing bottle station. It should be noted that, while a SOG dispensing apparatus is used to illustrate the present invention novel apparatus and method, the apparatus and the method can be used in dispensing any type of liquid as long as it is contained in a liquid supply bottle for feeding a process liquid to a process machine. The liquid dispensed by the present invention novel apparatus and method may not be a coating liquid, but can be any process liquid used in any type of chemical processes, including those for semiconductor processes.

The sliding blocks utilized in the present invention height adjustment means can have a maximum thickness between about 5 mm and about 50 mm, and preferably between about 10 mm and about 20 mm. By pushing the two sliding blocks toward each other, an increase in the elevation of the bottle can be achieved to a maximum of about 50 mm. The liquid level sensor may e used to sense a liquid level in the supply bottle as low as 200 cc when a 1,000 cc capacity bottle is positioned in the bottle station.

Figure 2:
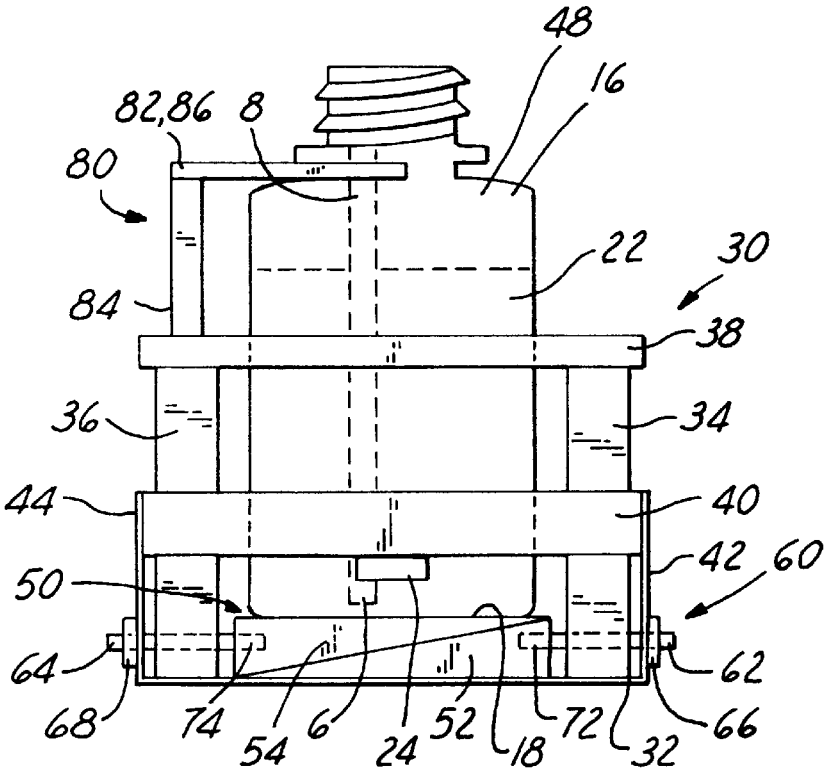
FIG. 2 is a cross-sectional view of a present invention SOG bottle station equipped with a height adjustment means and a bottle clamp.

Referring now to FIG. 2, wherein a present invention SOG bottle station 30 is shown. The SOG bottle station 30 is constructed of a base frame member 32, at least two side frames 34, 36 mounted to the base frame member 32, a top frame member 38 and a horizontal frame member 40 bridging between the two side frame members 34, 36. On the horizontal frame member 40, a level sensor 24 is mounted thereto for sensing a liquid level contained in the bottle 16. The level sensor 24 may be suitably a capacitance type sensor or may be any other type of suitable sensors.

In the liquid supply bottle 16, a dip tube, or a liquid supply tube 8 is inserted which has an open end 6 for taking in liquid from the bottom of the bottle 16. The open end 6 of the dip tube 8 is positioned in close proximity to the bottom surface 18 of the bottle 16.

Figure 3:
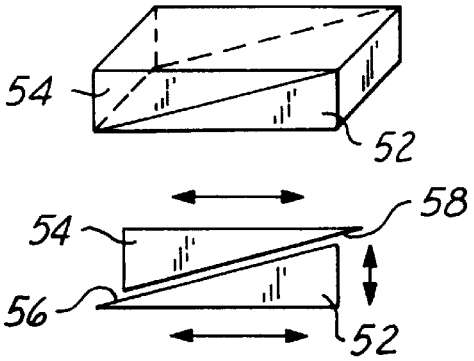
FIG. 3 is a perspective view and a cross-sectional view of the present invention height adjustment means.

Th present invention novel SOG bottle station 30 further includes a height adjustment means 50 which is positioned on the base frame 32 inside the station. A perspective view and a cross-sectional view of the height adjustment means 50 are also shown in FIG. 3, except the screw means 60 for advancing the two sliding blocks 52, 54 toward each other. The advancing means 60 includes screws 62, 64 which are held in place by threaded bolts 66, 68, respectively. The threaded bolts 66, 68 are in turn permanently fixed on the vertical portions 42, 44 of the base frame 32. Alternatively, the screws 62, 64 may be threadingly engaged to the side frames 34, 36 by female threads provided in the side frames. In such case, a straight hole is provided in the bolts 66, 68. Two inwardly facing ends 72, 74 of the screws 62, 64 are attached to the sliding blocks 52, 54 such that lateral movements of the two sliding blocks can be achieved in the horizontal direction.

It should further be noted, as shown in FIG. 3, the two hypotenuse surfaces 56, 58 are used to engage each other and to achieve a sliding motion thereinbetween. By pushing the sliding blocks 52, 54, either one or both, toward each other or pulling away from each other, the total height of the height adjustment means 50 can be increased or decreased. As previously stated, the sliding blocks 52, 54 may have a maximum thickness between about 5 mm and about 50 mm, and preferably between about 10 mm and about 20 mm. At the maximum thickness, a maximum adjustment of about 50 mm by the motions of the two sliding blocks can be achieved, even though a maximum increase of about 20 mm is normally adequate for a liquid supply bottle that has a capacity of 1,000 cc, such as those frequently used for SOG dispensing.

Figure 4A:
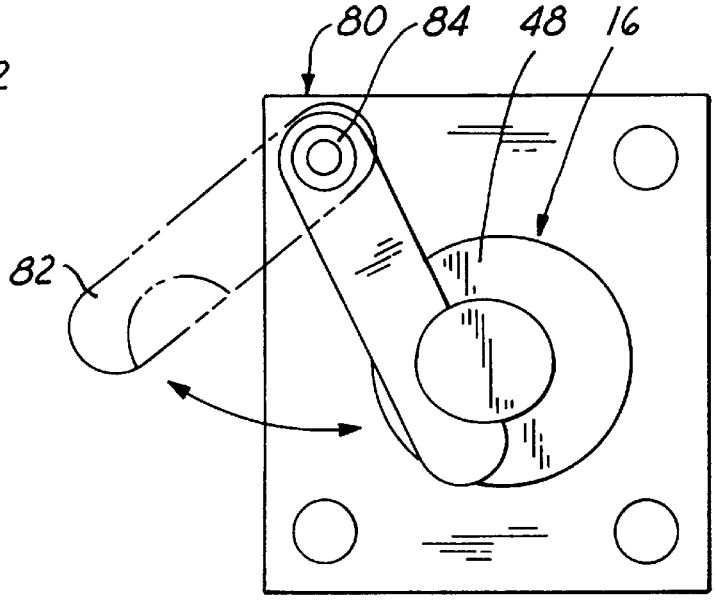
FIG. 4A is a plane view of a bottle clamp in a first embodiment.

A first embodiment of a bottle clamp 80, as shown in FIGS. 2 and 4A may be used to frictionally engage the top 48 of the liquid supply bottle 16. The bottle clamp 80, in the first embodiment shown in FIG. 4A, consists mainly of a horizontal arm 82 that is swivable when mounted on top of a vertical arm 84. To allow a height adjustment of the bottle 16, the horizontal arm 82 rides on top of the vertical arm 84 which slidingly engaging the side frame 36 such that it may be moved upwardly or downwardly.

Figure 4B:
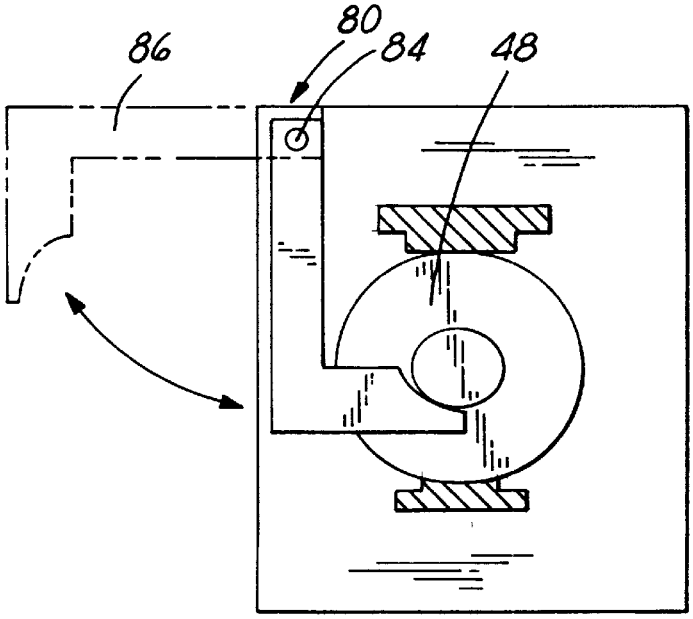
FIG. 4B is a plane view of a bottle clamp in a second embodiment.

A second embodiment of the bottle clamp 80 is shown in FIG. 4B wherein the horizontal arm 86 is provided in a 90° angle shape. The arm 86 functions similarly to that shown in the first embodiment in that it swivels on the vertical arm 84 and rides up and down with the vertical arm 84 to accommodate bottles of different heights.

The present invention novel apparatus for adjusting a minimum liquid level in a liquid supply bottle can be used in the following manner. When SOG dispensing is involved by using a 1,000 cc capacity SOG bottle, a minimum amount of liquid allowed to be left in the bottom of the bottle is first determined by a trial and error process. For instance, at a residual liquid level of 190 cc, air bubbles frequently appears in the liquid due to the low liquid level such that the coating process must be stopped. It was also found, by the trial and error process, at a residual liquid level of 215 cc, there is little chance for the occurrence of air bubble inclusion. A SOG liquid bottle containing 215 cc of SOG liquid is therefore first positioned in the SOG bottle station of the present invention, the position of a level sensor (or the capacitance sensor) is then adjusted to sense the liquid level at 215 cc and sends out a yellow warning signal to a machine operator. A portion of the SOG liquid in the bottle is then removed to allow only 190 cc of SOG liquid to remain in the bottle. The bottle is again positioned in the SOG bottle station and the level sensor is again adjusted to read the low liquid level and sends out a red warning signal which stops the operation of the coating apparatus. The SOG bottle station is then ready for use in a fabrication process utilizing a 1,000 cc capacity SOG bottle. When the level of liquid in the bottle goes down to approximately 215 cc, a yellow warning signal is first sent to the machine operator to remind him that the bottle should be replaced. If the yellow warning signal is ignored, the level sensor will again sense a low level at 190 cc and sends out a red warning signal to the machine operator, and regardless any action is taken by the operator, the coating apparatus is shut down to avoid the inclusion of air bubbles in the SOG material that is dispensed on a wafer surface. The present invention novel apparatus therefore permits a maximum utilization of a liquid stored in a liquid supply bottle, while insuring that the occurrence of air inclusion into the liquid can be completely avoided.

The present invention novel apparatus and method have therefore been amply described in the above descriptions and in the appended drawings of FIGS. 2–4B.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

1. An apparatus for adjusting a minimum liquid level in a liquid supply bottle comprising:

a base frame, at least two vertical side frames opposingly mounted on said base frame bridged by a horizontal frame, a bottle clamp having a vertical arm for frictionally engaging one of said at least two side frames and allowing a vertical motion of the clamp, and a horizontal arm for frictionally engaging a bottle positioned on a height adjustment means, and a height adjustment means positioned on said base frame for supporting said bottle, said height adjustment means comprises two sliding blocks each having a right-angled triangular cross-section slidingly engaging each other on their hypotenuses and two screws each threadingly engaging one of said at least two side frames for pushing said sliding blocks toward each other such that an elevation of the bottle is increased.

2. An apparatus for adjusting a minimum liquid level in a liquid supply bottle according to claim 1 further comprising a level sensor mounted on said horizontal frame for sensing a liquid level in said liquid supply bottle.

3. An apparatus for adjusting a minimum liquid level in a liquid supply bottle according to claim 2, wherein said level sensor is of the capacitance sensor type.

4. An apparatus for adjusting a minimum liquid level in a liquid supply bottle according to claim 2, wherein said level sensor senses a liquid level in sad liquid supply bottle at about 200 cc.

5. An apparatus for adjusting a minimum liquid level in a liquid supply bottle according to claim 1 further comprising a liquid feed tube mounted in said bottle having an open end immersed in a liquid held in said bottle.

6. An apparatus for adjusting a minimum liquid level in a liquid supply bottle according to claim 5, wherein said open end of said liquid feed tube is positioned adjacent to a bottom surface of said liquid supply bottle.

7. An apparatus for adjusting a minimum liquid level in a liquid supply bottle according to claim 1, wherein each of said sliding blocks having a maximum thickness between about 5 mm and about 50 mm.

8. An apparatus for adjusting a minimum liquid level in a liquid supply bottle according to claim 1, wherein each of said sliding blocks having a maximum thickness preferably between about 10 mm and about 20 mm.

9. An apparatus for adjusting a minimum liquid level in a liquid supply bottle according to claim 1, wherein said liquid supply bottle has a capacity of about 1000 cc.

10. An apparatus for adjusting a minimum liquid level in a liquid supply bottle according to claim 1, wherein said elevation of said liquid supply bottle is increased by a motion of said two sliding blocks to a maximum increase of about 20 mm.

11. An apparatus for adjusting a minimum liquid level in a liquid supply bottle according to claim 1, wherein said liquid supply bottle being adapted for holding a liquid of spin-on-glass or photoresist.

12. A method for adjusting a liquid level in a liquid supply bottle sensed by a level sensor comprising the steps of:

providing a bottle holding fixture including a base frame, at least two opposing side frames mounted on said base frame and a horizontal frame bridging said at least two side frames, positioning a height adjustment means consisting of two sliding blocks each having a right-angled triangular coss-section slidingly engaging each other on their hypotenuses on said base frame for supporting a bottle thereon, positioning a liquid supply bottle on said height adjustment means, holding a position of said liquid supply bottle by a bottle clamp which allows a vertical motion of said bottle, and pushing said two sliding blocks toward each other such that an elevation of the bottle is increased.

13. A method for adjusting a liquid level in a liquid supply bottle sensed by a level sensor according to claim 12, wherein said step of pushing said two sliding blocks toward each other further comprising:

mounting two screws by threadingly engaging each with one of said at least two opposing side frames and by attaching each of two inwardly facing ends of said screws to one of said sliding blocks, and turning at least one of said two screws and pushing said two sliding blocks toward each other.

14. A method for adjusting a liquid level in a liquid supply bottle sensed by a level sensor according to claim 12 further comprising the step of mounting a liquid feed tube in said bottle with an open end immersed in a liquid.

15. A method for adjusting a liquid level in a liquid supply bottle sensed by a level sensor according to claim 12 further comprising the step of pushing said two sliding blocks toward each other such that said elevation of the bottle is increased by at least 5 mm.

16. A method for adjusting a liquid level in a liquid supply bottle sensed by a level sensor according to claim 12 further comprising the step of pushing said two sliding blocks toward each other such that said elevation of the bottle is increased between about 5 mm and about 50 mm.

17. A method for adjusting a liquid level in a liquid supply bottle sensed by a level sensor according to claim 12 further comprising the step of mounting a level sensor on said horizontal frame for sensing a liquid level in said bottle.

18. A method for adjusting a liquid level in a liquid supply bottle sensed by a level sensor according to claim 12 further comprising the step of mounting a capacitance sensor on said horizontal frame for sensing a liquid level in said bottle.

19. A method for adjusting a liquid level in a liquid supply bottle sensed by a level sensor according to claim 12 further comprising the step of sensing a low liquid level in said liquid supply bottle by a level sensor and sending a signal to stop a delivery of liquid from said bottle.

20. A method for adjusting a liquid level in a liquid supply bottle sensed by a level sensor according to claim 12 further comprising the step of sensing a liquid level of about 200 cc in said liquid supply bottle by a capacitance sensor and sending a signal to stop a delivery of liquid from said bottle.

* * * * *